United States Patent [19]

Ritchie

[11] 4,373,725

[45] Feb. 15, 1983

[54] PINBALL MACHINE HAVING MAGNETIC BALL CONTROL

[75] Inventor: Steven S. Ritchie, Carpentersville, Ill.

[73] Assignee: Williams Electronics, Inc., Chicago, Ill.

[21] Appl. No.: 200,559

[22] Filed: Oct. 24, 1980

[51] Int. Cl.[3] ..... A63D 3/00

[52] U.S. Cl. ..... 273/121 A; 273/118 D

[58] Field of Search ..... 273/121 A, 118 A, 119 A, 273/120 A, 121 A, 122 A, 123 A, 124 A, 125 A, 118 D

[56] References Cited

U.S. PATENT DOCUMENTS

| | | | |
|---|---|---|---|
| 1,953,873 | 4/1934 | Warner | 273/121 A |
| 2,125,689 | 8/1938 | Radtke et al. | 273/121 A |
| 2,184,867 | 12/1939 | Williams | 273/119 |
| 2,251,009 | 7/1941 | Williams et al. | 273/121 A |
| 2,258,329 | 10/1941 | MacDougall et al. | 273/118 A |
| 4,256,307 | 3/1981 | Brooks | 273/118 |

OTHER PUBLICATIONS

"Pinch Hitter", Williams Electronics, Inc., Chicago, Illinois.

"Zodiac", Williams Electronics, Inc., Chicago, Illinois.

*Primary Examiner*—George J. Marlo

*Attorney, Agent, or Firm*—McDougall, Hersh & Scott

[57] ABSTRACT

Magnetic control of a ball on a pinball playfield is provided by an electromagnet located on the playfield and a mechanism manually operable by a player for energizing the electromagnet. The energizing mechanism includes a first switch external on the playfield operable by player and a second switch on the playfield which is activated by a ball hitting a target thereon. The first and second switch are connected in series with the electromagnet to control the latter. A timing mechanism is provided to limit the energization of the electromagnet to a predetermined time period.

11 Claims, 3 Drawing Figures

FIG. 1
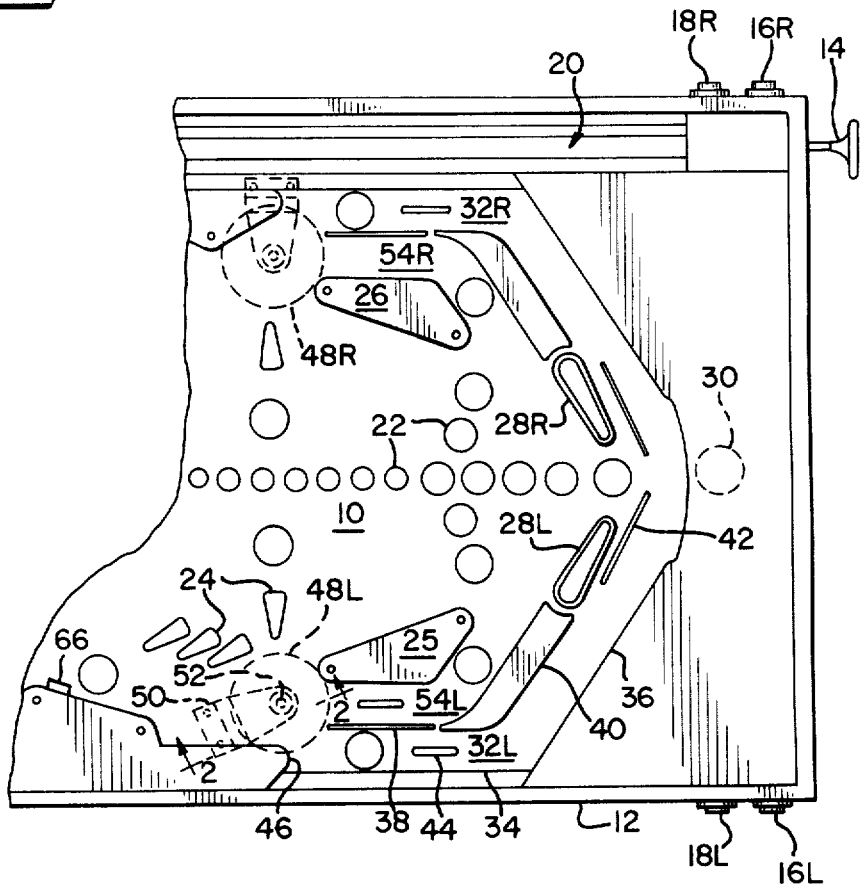
FIG. 3
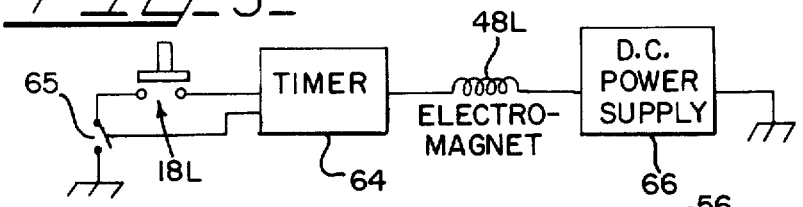
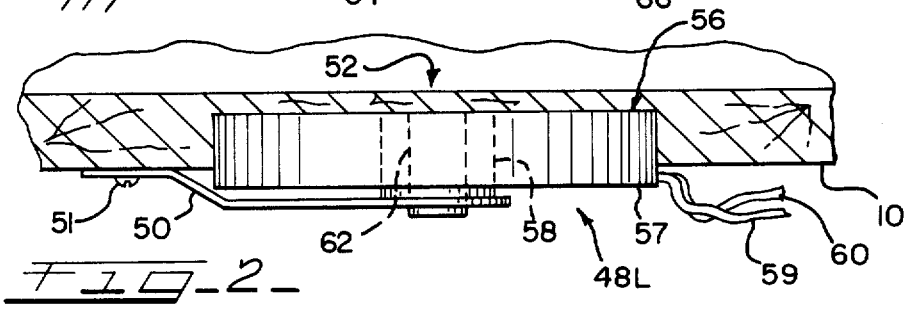
FIG. 2

PINBALL MACHINE HAVING MAGNETIC BALL CONTROL

BACKGROUND OF THE INVENTION

This invention relates generally to pinball machines and more specifically to electromagnetic control of a ball on a playfield of a pinball machine. As used herein, "playfield" refers to the active playing area on a pinball machine.

Conventional pinball machines include a spring-loaded plunger for impelling a ball onto the upper portion of an inclined planar playfield. Various devices including bumpers, kickers, targets and flippers are provided on the playfield. On a conventional pinball machine, only the flippers are under the direct control of the player and are activated by depressing externally located buttons or levers. Other ball impelling devices, such as kickers of various types, react automatically to contact with the ball and are not under the direct control of the player.

PRIOR ART

Electromagnets have been previously used in rolling ball games to influence the direction of magnetizable balls. The "Pinch-Hitter" baseball game made by Williams Electronics, Inc. allowed a mechanical pitcher to throw a curve ball by altering the path of the ball with an electromagnet. Prior to the ball being thrown, the player (or a different player acting as "pitcher") selected the type of pitch which would be thrown, such as either a fast ball or a curve, by means of push buttons corresponding to the type of pitch desired. Depressing the curve ball button energized an electromagnet which would alter the path of a ball as the ball approached home plate and a batting flipper.

"Zodiac", another pinball game manufactured by Williams Electronics, Inc., utilized an electromagnet which was energized upon a ball hitting a particular playfield target. The electromagnet was located in the vicinity of the target so that the ball was temporarily stopped for visual effect and for scoring purposes.

U.S. Pat. No. 2,258,329 discloses a pinball game with a magnetizable ball and a plurality of electromagnets located underneath the playfield. The electromagnets are energized by switches located on a playfield in response to contact with the ball.

SUMMARY OF THE INVENTION

The present invention provides an improved pinball machine having an electromagnet located adjacent an entry port to an exit lane and a means manually operable by a player for energizing the electromagnet. This allows a player to attract a ball away from the entry port thus preventing the ball from entering the exit lane which would have ended play with that ball. A further feature of the present invention provides a means for limiting the time during which the electromagnet can be energized.

An object of the present invention is to provide a pinball player with an additional level of control thereby providing an increased challenge of the player's skills.

The preferred embodiment of the present invention is described below and illustrated in accompanying drawings in which:

FIG. 1 is a partial top view of a lower portion of a pinball machine;

FIG. 2 is a partial cross-sectional view taken at about line 2—2 in FIG. 1; and

FIG. 3 is an electrical block diagram.

DETAILED DESCRIPTION OF THE PREFERRED EMBODIMENT

Referring to FIG. 1, inclined playfield 10 is mounted inside pinball cabinet 12 to which is also mounted spring loaded plunger 14, left push buttons 16L, 18L and corresponding right push butttons 16R, 18R. The function of these push buttons will be described in greater detail hereinafter. Balls are shot by a plunger 14 along track 20 onto the upper end of inclined playfield 10 (not shown).

A variety of conventional lighting may be employed on playfield 10 such as recessed circular lights 22 and arrow shaped lights 24. These lights consist of conventional plastic jewels (inserts) of corresponding shapes which provide a continuously smooth top playing surface of the playfield and have individually controlled light sources thereunder. The playfield may contain a variety of ball impelling devices such as slingshot kickers 25, 26 and left and right flippers 28L, 28R which are solenoid operated responsive to corresponding left and right push buttons 16L, 16R. A player exercises his skill in operating these flippers by impelling a ball to the upper areas of playfield 10 to strike targets thereby accumulating points. All of these are conventional game elements and may be selected and located by the game designer.

Normally a ball exits the playfield by means of out-hole 30 by either passing between the flippers or by passing behind the flippers by exit lanes 32L, 32R. As used herein an "out-hole" refers to an exit port for a ball which terminates play with that ball. These exit lanes in the game illustrated are defined by side wall 34, end wall 36 and dividers 38, 40, flipper 28L, and divider 42. The exit lanes also contain a ball activated switch 44. The opening between the upper end of divider 38 and the lower portion of side bumper 46 generally defines the entrance or entry port to exit lane 32L. Right exit lane 32R is complementary in all respects to left exit lane 32L which has been described above.

In accordance with this invention, electromagnets 48L, 48R are mounted beneath the playing surface of playfield 10 by means of brackets 50. These electromagnets are connected to be energized respectively by push buttons 18L, 18R under the control of the player. When energized, the electromagnets afford the player an opportunity to attract the ball which is susceptible to magnetic attraction, away from the entry port preventing the ball from being lost through the exit lane and out-hole 30. The electromagnets produce a sufficient magnetic field so as to pull a ball away from an entry port by attracting the ball to its magnetic center 52. The magnetic center of the electromagnet is substantially lateral of the entry port of the exit lane and holds the ball on the surface of playfield 10 until the magnet is de-energized. In the embodiment illustrated, the magnetic center 52 is located above the flipper return lanes so that the ball will enter the left flipper return lane 54L (or the right flipper return lane 54R) which routes the ball to the operative side of the flipper allowing a player to energize the flipper sending the ball upward onto the playfield. Thus a player can "save" a ball which would ordinarily be lost through an exit lane by energizing the electromagnet at the appropriate time.

Referring to FIG. 2, electromagnet 48L is shown held in recess 56 of playfield 10 by means of mounting bracket 50. The playfield 10 is ordinarily constructed of a non-magnetic sheet of material and is provided with a circular recess 56 dimensioned to leave a portion of the playfield remaining above the recess. Mounting bracket 50 may be secured to the bottom surface of playfield 10 by any suitable means such as screws 51. The electromagnet 48L includes a cylindrical spool 57 having a hollow core 58 on which a multiple turn winding is wound with wires 59, 60 providing electrical connection to this winding. The bracket 50 in addition to supporting the coil contains a steel rod 62 which projects into core 58 so as to form a north-south magnetic pole. This steel rod also serves to mount the cylindrical spool in recess 56. In one design the spool 57 has a hollow center core 58 of 0.75 inches in diameter, is 0.75 inches in thickness, and has a winding of approximately 675 turns of No. 22 enamelled wire. In this same embodiment of the present invention such a winding is driven by a 28 volt DC power supply.

Referring to FIG. 3, a block diagram illustrates a circuit which limits the time during which an electromagnet can be energized. A normally open push button switch 18L and a normally open target switch 65 connect timer 64 to a chassis ground. Switch 65 closes in response to a target 66 on the playfield, such as a conventional drop target, being hit. Timer 64, which may consist of a conventional monostable circuit, has an output that is connected to electromagnet 48L and provides a return path to chassis ground while the timer is activated allowing DC power supply 66 to provide current through the electromagnet. Switches 18L and 65 must both be closed to trigger the timer which has a predetermined timing interval. Thus before a player can activate an electromagnet he must first have hit the target to which switch 65 is responsive. Having accomplished this feat, he may then trigger the timer by player controlled switch 18L at his discretion in order to save a ball from entering an exit lane. A circuit complementary to that shown in FIG. 3 may be employed to control electromagnet 48R. If desired, the timer output can be used to reset the target to which switch 65 is responsive upon the end of the predetermined time period thereby requiring a player to again hit this target before the electromagnet can be energized. The circuitry shown in FIG. 3 prevents a player from continuously keeping the electromagnets energized.

It is to be understood that alternative circuits and timing devices may be used to implement the function of the specific block circuitry illustrated in FIG. 3. For example, delayed release relays could be employed as well as suitable software for a microprocessor control pinball machine. Alternative means of reducing the likelihood of a player continuously activating the electromagnets could be employed such as by physically separating the magnetic control push buttons and the flipper control push buttons making it unlikely that a player could simultaneously reach both of the buttons. It will be appreciated by those skilled in the art that time limiting circuitry such as illustrated in FIG. 3 is advantageous but not essential for the operation of the magnetic control of a ball as disclosed herein. This invention is also applicable to pinball machines having exit means other than exit lanes, such as exit holes, located at various locations on the playfield. The present invention has been illustrated in conjunction with exit means as illustrative only of a particular application and is not to be considered as limited exclusively thereto.

The electromagnetic control afforded by the present invention provides the player with a heretofore unavailable feature thereby increasing the level of sophistication and skill tested by pinball games.

While the preferred embodiment of the present invention has been described above and illustrated in the accompanying drawings, it is to be understood that the scope of the present invention is defined by the claims appended hereto.

What is claimed is:

1. An improved pinball machine including an inclined playfield having targets, balls susceptible to magnetic attraction, and a means for propelling said balls into play upon said playfield, the improvement comprising:

(a) an electromagnet operatively associated with said playfield;

(b) a first switch external of said playfield which can be activated by a player;

(c) a second switch which is actuated by a ball operating one or more targets on said playfield; and (d) said electromagnet, said first switch, and said second switch connected in circuit so that a ball which hits said target thereby activating said second switch may thereafter be selectively attracted by said electromagnet upon activation of said first switch by the player thereby to alter or stop the motion of such ball.

2. The pinball machine of claim 1 further comprising a timing means connected in circuit with said electromagnet, said first switch, and said second switch for limiting the time during which the electromagnet can be energized to a predetermined time period thereby preventing a player from continuously energizing said electromagnet.

3. The pinball machine according to claim 2 wherein said timing means comprises a monostable.

4. The pinball machine according to claim 2 wherein said timing means, upon timing out, resets said second switch thereby requiring the player to again activate said second switch by hitting said target with a ball before said electromagnet can be energerized by the player.

5. The pinball machine according to claims 1, 2, 3, or 4 further comprising an out-hole at the lower end of said playfield, a player controlled flipper located adjacent the out-hole, and an exit lane having an entry port located at a higher level on said playfield than said flipper, said electromagnet located lateral of said entry port thereby providing the player with an opportunity to prevent a ball from entering said entry port by energizing said electromagnet to attract said ball away therefrom.

6. An improved pinball machine including an inclined playfield having targets, balls susceptible to magnetic attraction, and a means for propelling said balls into play upon said playfield, the improvement comprising:

(a) an electromagnet operatively associated with said playfield;

(b) a first switch external of said playfield which can be activated by a player to energize said electromagnet; and (c) a timing means connected in circuit with said electromagnet and said first switch for limiting the time during which the electromagnet can be energized to a predetermined time period thereby preventing a player from continuously energizing said electromagnet.

7. The pinball machine according to claim 6 further including a means in circuit with said electromagnet and said first switch for preventing the activation of said electromagnet until one ball operates at least one designated target on said playfield so that said one ball may thereafter be selectively attracted by the player to alter or stop the motion of such ball.

8. The pinball machine according to claim 7 wherein said preventing means comprises a second switch associated with one or more targets on said playfield responsive to a ball striking said targets.

9. The pinball machine according to claim 6 wherein said timing means comprises a monostable.

10. The pinball machine according to claim 7 wherein said timing means, upon timing out, resets said preventing means thereby requiring the player to again activate said designated target with a ball before said electromagnet can be energized by the player.

11. The pinball machine according to claims 6, 7, 8, 9, or 10 further comprising an out-hole at the lower end of said playfield, a player controlled flipper located adjacent the out-hole, and an exit lane having an entry port located at a higher level on said playfield than said flipper, said electromagnet located lateral of said entry port thereby providing the player with an opportunity to prevent a ball from entering said entry port by energizing said electromagnet to attract said ball away therefrom.

* * * * *